US005281252A

United States Patent [19]

Landolt et al.

[11] Patent Number: 5,281,252

[45] Date of Patent: Jan. 25, 1994

[54] CONVERSION OF NON-FERROUS SULFIDES

[75] Inventors: Carlos A. Landolt, Lively; Samuel W. Marcuson; David E. Hall, both of Sudbury, all of Canada

[73] Assignee: Inco Limited, Toronto, Canada

[21] Appl. No.: 993,258

[22] Filed: Dec. 18, 1992

[51] Int. Cl.[5] ..... C22B 15/06

[52] U.S. Cl. ..... 75/585

[58] Field of Search ..... 75/585, 643

[56] References Cited

U.S. PATENT DOCUMENTS

| | | | |
|---|---|---|---|
| 3,281,236 | 10/1966 | Meissner | 75/73 |
| 4,416,690 | 11/1983 | Richards et al. | 75/26 |
| 4,469,513 | 9/1984 | Staib | 75/76 |
| 4,614,542 | 9/1986 | Kimura | 75/643 |
| 4,830,667 | 5/1989 | Marcuson et al. | 75/76 |

FOREIGN PATENT DOCUMENTS

| | | |
|---|---|---|
| 941171 | 2/1974 | Canada . |
| 2035542 | 8/1992 | Canada . |
| 2041297 | 10/1992 | Canada . |

OTHER PUBLICATIONS

Bustos "Recent Developments in the Teniente Modified Converter Operation and in Converter Slag Cleaning at the Caletones Smelter", *Pyrometallurgy '87* 1987, pp. 1031-1045.

Matthew et al., "The Continuous Isasmelt Lead Process", *Lead-Zinc '90*, 1990, pp. 889-901.

Floyd et al., "Sirosmelt and The Wide World of Opportunity", *Engineering & Mining Journal*, Jun. 1985, pp. 52-56.

Nagano et al., "Commercial Operation of Mitsubishi Continuous Copper Smelting and Converting Process", *International Symposium on Copper Extraction & Refining*, 1976, pp. 439-457.

Diaz-"Conversion of Nickel and Sulfur-Containing Copper to Blister", Copper 87, vol. 4, Pyrometallurgy of Copper, pp. 294-304.

U.S. patent application Ser. No. 07/959,837 "Conversion of Non-Ferrous Matte" Marcuson et al.

*Primary Examiner*—Peter D. Rosenberg

*Attorney, Agent, or Firm*—Blake T. Biederman; Edward A. Steen

[57] ABSTRACT

The invention relates to the smelting or converting of particulate sulfide material, such as nickel or copper sulfide. A molten seed bath of smelted or converted material is provided in a reaction vessel. Particulate sulfide material is injected into a reaction vessel below the surface of the melt. Top blowing with an oxygen-containing gas generates heat and brings about the oxidation of the sulfides with a significant decrease in the amount of dust generated. Optional bottom stirring with a non-reactive gas such as nitrogen may further increase efficiency.

13 Claims, No Drawings

CONVERSION OF NON-FERROUS SULFIDES

BACKGROUND OF THE INVENTION

This invention relates to the pyrometallurgical treatment of non-ferrous sulfide material. More particularly, it relates to the smelting or converting of particulate non-ferrous sulfide material, such as nickel or copper sulfide. In the claimed process, particulate sulfide material is injected into a reaction vessel below the surface of a melt. Top blowing with an oxygen-containing gas generates heat and brings about the oxidation of the sulfides with a significant reduction in the amount of dust generated.

One currently practiced method for treating sulfide ore concentrates is by flash smelting/converting in which the sulfur and iron content of the ore is burned while the concentrate is suspended in the oxidizing medium. This method permits economical treatment of the furnace off-gas to recover a substantial part of the liberated sulfur content.

A serious drawback to flash operations is the generation of substantial amounts of dust, which must be removed in the gas cleaning system prior to further treatment for recovery of sulfur dioxide. In contrast, injection of the sulfide material below the bath surface results in a substantial decrease in the amount of dust produced.

In flash smelting/converting, the heat of combustion is generated in the free board of the furnace and can lead to overheating of the refractory. In the process of the invention, which utilizes top blowing technology, heat is generated on the bath surface away from the walls of the reaction vessel. An additional embodiment of the invention utilizes non-reactive gas sparging as a bottom stirring mechanism. The stirring of the bath created by the gas sparging distributes this heat, causing the bath to reach a uniform temperature. Thus, damage to the refractory is significantly reduced. Furthermore, it is likely that the reactor used for the present process (usually of the Pierce-Smith converter type because of the ease of retrofitting) will have a higher specific capacity than a flash reactor.

The top blowing process alone is not without its disadvantages. Though oxygen efficiency is high, it may be less than the 100% achieved during flash reaction. However, when the top blowing process is utilized in conjunction with particulate injection below the bath surface, it was surprisingly found that the overall economics of this unique process were superior to those of flash reaction. This is particularly true when the problem of dust generation is considered. For example, when treating chalcocite, flash converting results in up to 15% of fed copper ending up as dust. The submerged injection of chalcocite would reduce this amount considerably.

Suggestions have been made in the past to inject solids below the melt surface in combination with submerged blowing with air or oxygen-enriched air. While this prior art method, taught by U.S. Pat. No. 3,281,236 to Meissner, would reduce the dusting caused by flash reaction, there are significant drawbacks. There would be additional fuel requirements due to the lower level of oxygen enrichment and a larger, more costly gas cleaning system to handle the resulting higher off-gas rates. Were tonnage oxygen to be used in such a process, shrouded tuyeres would be required. Furthermore, these processes are known to suffer from excessive refractory and tuyere wear.

The desirability of using "top blowing/bottom stirring" technology in a preferred embodiment, as compared to simply blowing with oxygen-containing gas, was first demonstrated by Marcuson et al with respect to the conversion of white metal copper in U.S. Pat. No. 4,830,667. The additional use of bottom stirring, along with top blowing and submerged particulate injection, would further assist in overcoming the above problems. Bottom stirring increases the circulation of the molten bath to allow for increased contact with the top blown oxygen. Thus, lance and vessel design are simplified and less costly, and reaction efficiency is increased.

SUMMARY OF THE INVENTION

The smelting/converting method of the invention contemplates the submerged injection of particulate sulfide material, such as nickel and/or copper sulfide into a molten bath. The bath is top blown with an oxygen-containing gas. The bath may be optionally stirred from below with a non-reactive gas, such as nitrogen.

The action of the injection tuyeres creates significant agitation of the bath. This stirring action, combined with blowing from above with an oxygen containing gas through a lance directed at the bath, eliminates the need for consumable lances or submerged tuyeres for the introduction of oxygen. This stirring can be enhanced further by the use of non-reactive gas sparging from below. The claimed invention overcomes the problem of tuyere wear associated with oxygen injection by supplying oxygen from above while injecting the sulfide material under the bath surface. The agitation created by the solids injection and, optionally by sparging with a non-reactive gas, circulates the molten bath so that contact is made at the bath surface with the oxygen-containing gas. Furthermore, the problem of dusting is greatly reduced as compared to flash reacting by the submerged injection of the particulate sulfides.

An improved tuyere injector which is particularly suitable for submerged injection of particulate sulfides in the claimed process is of the type described in Canadian Laid-Open Application No. 2,035,542.

Overall, the unique concept of injecting particulate sulfide material into a molten bath combined with the advantageous use of top blowing results in a clean, inexpensive and efficient converting method. Furthermore, this novel process may be advantageously conducted using a Pierce-Smith type rotary conversion vessel, which may be readily retrofitted with the necessary equipment.

DETAILED DESCRIPTION OF THE INVENTION

Several tests were run to demonstrate the efficacy of the claimed method. Discrete runs within each test were terminated to allow for the taking of samples and the adjustment of the injectors and burners.

Dry particulate chalcocite of nominal composition 75% copper, 20% sulfur, 3% nickel, was injected into a reaction vessel of the Pierce-Smith converter type during a series of six tests. A seed bath consisting of approximately 137 tonnes semi-blister was prepared in the vessel prior to each test. A supplemental oxy-gas burner was used to maintain temperature in the bath during injection. Two tuyeres of the type described in Canadian Application No. 2,035,542 were located 8 feet (2.4 m) from each end wall.

Injection rates through the two tuyeres present ranged from 18.2–27.3 tonnes per hour. A portable compressor was used to supply the conveying air at 120 psi (828 kPa) to the tuyere blow tanks. This resulted in tank pressures of 80–90 psi (552–621 kPa) and a pressure at the tuyeres of 40 psi (276 kPa). Bottom stirring was accomplished by sparging nitrogen through five porous plugs spaced along the bottom of the reactor shell.

TABLE 1

| | | | CHALCOCITE | | BURNERS | | | |
|---|---|---|---|---|---|---|---|---|
| | | | | | OXY-GAS | | $O_2$ LANCE | |
| TEST NO. | RUN | TIME (MIN.) | RATE (TONNES/HR.) | AMOUNT (TONNES) | NAT. GAS ($STDM^3$/MIN) | $O_2$ (TONNES/DAY) | NAT. GAS ($STDM^3$/MIN.) | $O_2$ (TONNES/DAY) |
| 1 | A | 60 | 27.3 | 27.3 | 7.0 | 34.6 | 3.5 | 72.8 |
| | B | 60 | 25.5 | 25.5 | 5.6 | 27.3 | 3.5 | 72.8 |
| | TOTAL | 120 | — | 52.8 | — | — | — | — |
| 2 | A | 60 | 21.8 | 21.8 | 3.5 | 18.2 | 3.5 | 63.7 |
| | B | 50 | 18.2 | 15.5 | 8.4 | 41.0 | 3.5 | 18.2 |
| | C | 70 | 18.2 | 20.9 | 8.4 | 41.0 | 3.5 | 36.4 |
| | TOTAL | 180 | — | 58.2 | — | — | — | — |
| 3 | A | 85 | 20.0 | 29.1 | 8.4 | 41.0 | 3.6 | 41.0 |
| | B | 80 | 22.8 | 30.0 | 8.4 | 41.0 | 3.6 | 36.4 |
| | C | 95 | 25.5 | 41.0 | 8.4 | 41.0 | 3.6 | 36.4 |
| | D | 90 | 22.8 | 34.6 | 5.6 | 27.3 | 3.6 | 31.9 |
| | TOTAL | 350 | — | 134.7 | — | — | — | — |
| 4 | A | 130 | 22.8 | 49.1 | 8.4 | 41.0 | 3.6 | 38.2 |
| | TOTAL | 130 | — | 49.1 | — | — | — | — |

| | | | BATH TEMPERATURE (°C.) | | WEIGHT % SULFUR | |
|---|---|---|---|---|---|---|
| TEST NO. | RUN | TIME (MIN.) | START | FINISH | START | FINISH |
| 1 | A | 60 | — | 1293 | 1.05 | 0.54 |
| | B | 60 | 1260 | 1282 | 0.54 | 0.77 |
| | TOTAL | 120 | — | — | — | — |
| 2 | A | 60 | 1204 | 1232 | 1.20 | 0.865 |
| | B | 50 | — | 1243 | 0.865 | 1.09 |
| | C | 70 | — | 1249 | 1.09 | 0.990 |
| | TOTAL | 180 | — | — | — | — |
| 3 | A | 85 | 1171 | 1221 | — | 2.88 |
| | B | 80 | 1221 | 1260 | 2.88 | 1.32 |
| | C | 95 | 1260 | 1282 | 1.32 | 1.14 |
| | D | 90 | 1266 | 1260 | 1.14 | 1.23 |
| | TOTAL | 350 | — | — | — | — |
| 4 | A | 130 | 1216 | 1216 | 0.55 | 1.31 |
| | TOTAL | 130 | — | — | — | — |

TABLE 2

| | | | CHALCOCITE | | BURNERS | | | |
|---|---|---|---|---|---|---|---|---|
| | | | | | OXY-GAS (1) | | OXY-GAS (2) | |
| TEST NO. | RUN | TIME (MIN.) | RATE (TONNES/HR.) | AMOUNT (TONNES) | NAT. GAS ($STDM^3$/MIN) | $O_2$ (TONNES/DAY) | NAT. GAS ($STDM^3$/MIN.) | $O_2$ (TONNES/DAY) |
| 5 | A | 49 | 12.7 | 10.4 | 8.4 | 41.0 | 8.4 | 41.0 |
| | B | 71 | 12.7 | 15.1 | 5.6 | 27.3 | 5.6 | 27.3 |
| | C | 153 | 12.7 | 32.5 | 5.6 | 27.3 | 5.6 | 27.3 |
| | D | 132 | 12.7 | 28.0 | 4.6 | 22.8 | 4.6 | 22.8 |
| | TOTAL | 405 | — | — | — | — | — | — |
| 6 | A | 223 | 10.9 | 41.0 | 5.6 | 27.3 | 5.6 | 27.3 |
| | B | 103 | 10.9 | 18.2 | 7.0 | 33.7 | 7.0 | 33.7 |
| | C | 130 | 12.7 | 27.3 | 6.3 | 30.9 | 6.3 | 30.9 |
| | D | 126 | 12.7 | 27.3 | 5.6 | 27.3 | 5.6 | 27.3 |
| | TOTAL | 582 | — | — | — | — | — | — |

| | | | BATH TEMPERATURE (°C.) | | WEIGHT % SULFUR | |
|---|---|---|---|---|---|---|
| TEST NO. | RUN | TIME (MIN.) | START | FINISH | START | FINISH |
| 5 | A | 49 | 1182 | — | 1.60 | — |
| | B | 71 | — | 1249 | — | — |
| | C | 153 | 1232 | 1260 | — | — |
| | D | 132 | 1260 | 1282 | — | 11.47 (a)<br>1.60 (b)<br>1.65 (c) |
| | TOTAL | 405 | — | — | — | — |
| 6 | A | 223 | 1177 | 1180 | — | — |
| | B | 103 | 1177 | 1210 | — | — |
| | C | 130 | 1210 | 1232 | — | — |
| | D | 126 | 1232 | 1232 | — | 12.25 (a)<br>1.76 (b)<br>1.70 (c) |

TABLE 2-continued

| | | | | | |
|---|---|---|---|---|---|
| TOTAL | 582 | — | — | — | — |

(a) first ladle sample - top layer
(b) second ladle sample - under layer
(c) third ladle sample - under layer For test nos. 1–4, a water-cooled oxygen lance, also equipped for natural gas addition, was mounted at a 45 degree angle through the end of the reactor shell, and employed to convert the injected chalcocite to semi-blister (less than 4% sulfur). As shown in Table1, sampling confirmed that a bath of semi-blister existed at the end of each injection period.

Comparison test nos. 5 and 6 demonstrate the effect that oxygen blowing has on fuel consumption and smelting results. In these tests, oxygen was not lanced into the vessel, and the sources of oxygen available for reaction were the feed conveying air and any infiltration through the converter mouth. A second oxygas burner was needed to maintain temperature, which suffered from the absence of oxygen blowing and the loss of heat generated from the diminished sulfide reaction. As shown in Table 2, a high concentration of sulfur (11.47–12.25%) remained in the top portion of the bath at the end of the cycle in the form of white metal ($Cu_2S$). In these two tests, only one tuyere was operated and the injection rate was about half that of the first tests; however, the natural gas rates were about the same.

The dust loading in the off-gas from the reaction vessel was measured during two injection periods. This value plus the amount of dust captured in the flue indicated a 1% dust loss. The identical test was performed on a flash converter resulting in a 5% dust loss. Though these numbers represent a crude comparison, they indicate a significant environmental advantage for the claimed process.

It should be apparent that the claimed process is extendable to the treatment of other non-ferrous sulfides, such as nickel sulfides and iron-containing nickel and/or copper sulfides.

In the case of iron-containing non-ferrous sulfides, additional steps are required by the resulting slag formation on the bath surface. Slag formation may result in two distinct but related problems. If the slag layer becomes too thick it will interfere with the conversion process by hindering the interaction between the molten non-ferrous sulfides in the bath and the top-blown oxygen. Additionally, an overly thick slag may result in unwanted excessive splashing. The thickness of the slag layer should be controlled by allowing for the continuous overflow of slag, or by frequently tapping or pouring the slag from the reactor.

A second problem resulting from slag formation is that as the conversion process proceeds to increasingly oxidized conditions, the slag will tend to become thick and non-fluid due to the formation of magnetite. The addition of a lime flux is advantageous in maintaining the fluidity of the slag in the case of copper sulfide processing. In the case of nickel sulfide processing, it has been suggested that a combined lime/silica flux can be effective.

What is claimed is:

1. A method for smelting or converting particulate non-ferrous sulfide material, comprising:
   - providing a molten bath of sulfide material in a reaction vessel, the bath having a top surface,
   - injecting particulate sulfide material into the bath below the top surface of the bath through at least one tuyere,
   - bottom stirring the bath with a non-reactive gas through at least one porous plug,
   - top blowing the bath with an oxygen-containing gas to convert the sulfide material to metal and sulfur-containing gas, and
   - preventing resulting slag on the top surface of the bath from interfering with the sulfide conversion reaction.

2. The method of claim 1, wherein the non-ferrous sulfide material is nickel and/or copper sulfide.

3. The method of claim 1, wherein the molten bath provided is a seed bath comprising smelted or converted copper sulfide material.

4. The method of claim 1, wherein top blowing is accomplished through a lance projecting into the reaction vessel above the molten bath.

5. The method of claim 1, wherein the oxygen-containing gas is oxygen.

6. The method of claim 1, wherein the non-reactive gas is nitrogen.

7. A method for smelting or converting particulate iron-containing non-ferrous sulfide material, comprising:
   - providing a molten bath of sulfide material in a reaction vessel, the bath having a top surface,
   - injecting particulate sulfide material into the bath below the top surface of the bath through at least one tuyere,
   - bottom stirring the bath with a non-reactive gas through at least one porous plug,
   - top blowing the bath with an oxygen-containing gas to convert the sulfide material to metal and sulfur-containing gas, and
   - preventing resulting iron-containing slag layer on the top surface of the bath from interfering with the sulfide conversion reaction.

8. The method of claim 7, wherein the non-ferrous sulfide material is nickel and/or copper sulfide.

9. The method of claim 7, wherein the molten bath provided is a seed bath comprising smelted or converted copper sulfide material.

10. The method of claim 7, wherein top blowing is accomplished through a lance projecting into the reaction vessel above the molten bath.

11. The method of claim 7, wherein the oxygen-containing gas is oxygen.

12. The method of claim 7, wherein the thickness of the slag layer is maintained by either continuous or periodic removal of slag so that the slag layer does not interfere with the smelting or converting operation.

13. The method of claim 7, wherein the non-reactive gas is nitrogen.

* * * * *